US005472204A

United States Patent [19]

English et al.

[11] Patent Number: 5,472,204

[45] Date of Patent: Dec. 5, 1995

[54] PUTTER HAVING AN OPTICALLY-BASED AIMING SYSTEM

[75] Inventors: Ralph R. English, Saginaw; Shan A. English, Wiley, both of Tex.

[73] Assignees: Philip C. McGahey; Herman J. Veselka, both of Arlington, Tex.; a part interest to each

[21] Appl. No.: 270,355

[22] Filed: Jul. 5, 1994

[51] Int. Cl.[6] ..... A63B 69/36

[52] U.S. Cl. ..... 273/186.3; 362/191; 362/427

[58] Field of Search ..... 273/186.3, 186.2, 273/194 R; 434/252

[56] References Cited

U.S. PATENT DOCUMENTS

| | | | |
|---|---|---|---|
| 3,070,373 | 12/1962 | Mathews et al. | 273/186.3 |
| 3,820,795 | 6/1974 | Taylor | 273/186.3 |
| 3,863,933 | 2/1975 | Tredway | 273/186.3 |
| 3,954,271 | 5/1976 | Tredway | 273/187.2 X |
| 4,148,096 | 4/1979 | Haas et al. | 273/186.3 X |
| 5,207,429 | 5/1993 | Walmsley et al. | 273/186.3 |
| 5,213,331 | 5/1993 | Avanzini | 273/186.3 |
| 5,388,831 | 2/1995 | Quadri et al. | 273/186.3 |

*Primary Examiner*—George J. Marlo
*Attorney, Agent, or Firm*—Charles W. McHugh

[57] ABSTRACT

An aiming apparatus attached to the shaft of a putter to help a golfer achieve a desired orientation for the putter's head, said desired orientation being one in which the head is desirably oriented with respect to a target toward which a golfer is about to direct a ball, said putter having an elongated shaft with proximal and distal ends, and there being a grip affixed to the shaft's proximal end and a head affixed to the shaft's distal end, comprising:

a) a clamp selectively attached to the putter's shaft near the grip;

b) a battery-operated generator of radiant energy that is selectively operable by a golfer to direct a narrowly focussed beam of radiant energy in a predictable direction, said radiant energy being within the range of wavelengths that are visible to the human eye, and the generator having a housing;

c) a device for supporting the generator housing with respect to the clamp in such a way that the direction of the beam of radiant energy may be selectively varied by the golfer while the golfer is holding the putter with a generally upright orientation, and the beam of radiant energy extending from the generator to a spot that lies generally between the putter's head and the target, and said spot being visible to a golfer; and d) a battery which is selectively connectable to the generator; such that the generator may be selectively energized by a golfer in order to generate a focussed beam of radiant energy to create the visible spot.

21 Claims, 3 Drawing Sheets

FIG. 6
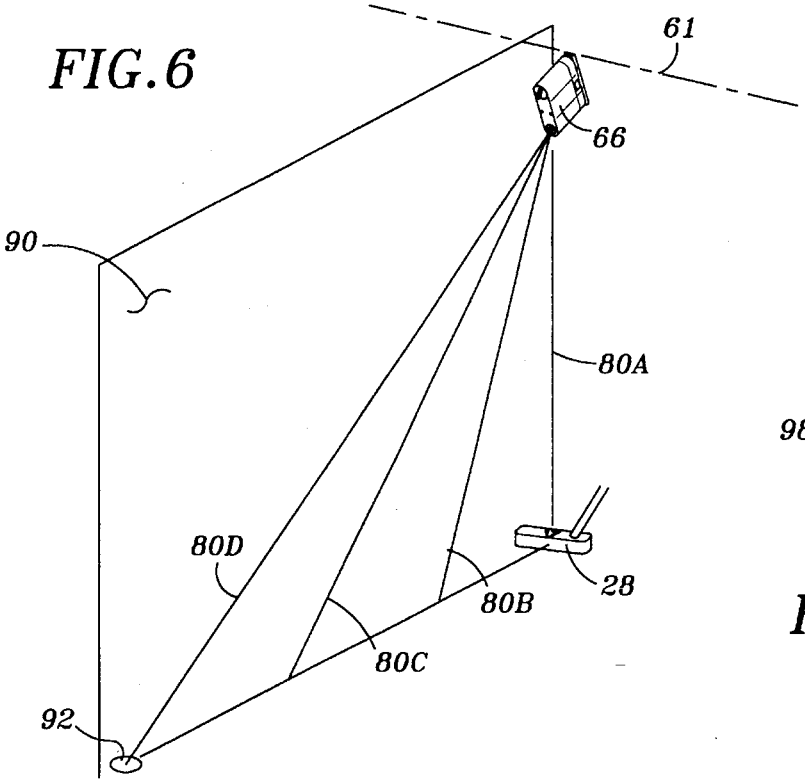
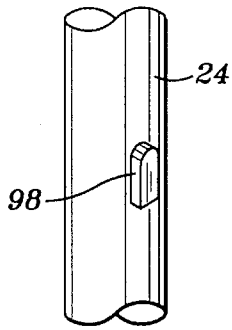
FIG. 9
FIG. 8
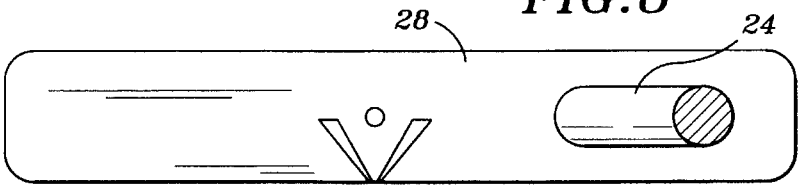
FIG. 10
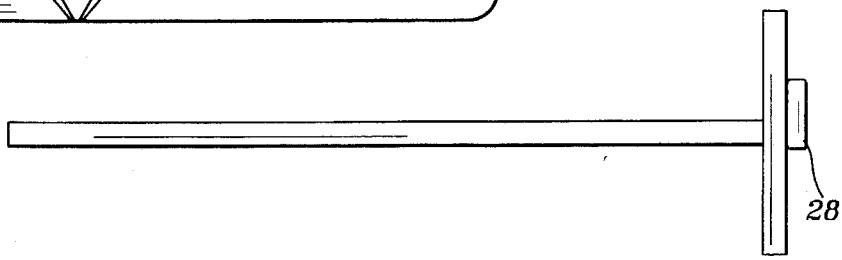
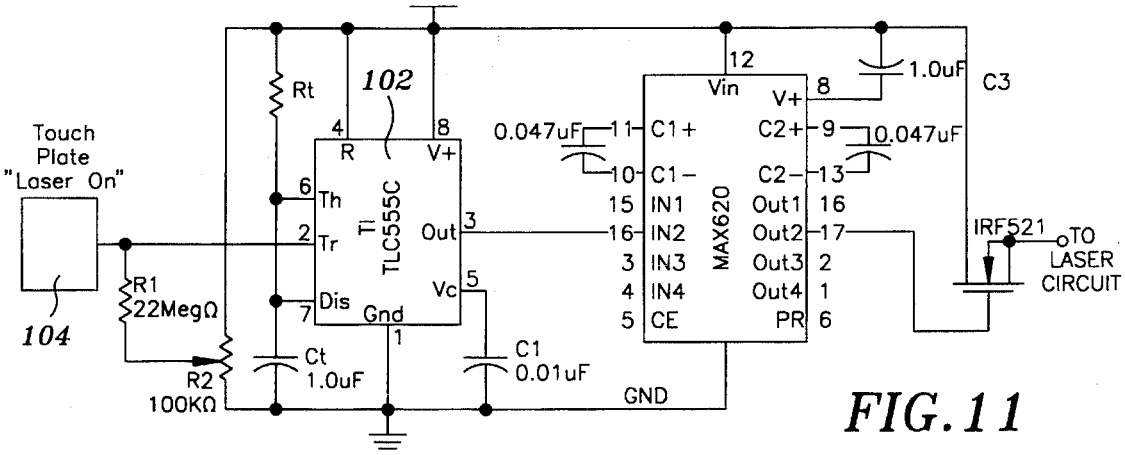
FIG. 11

PUTTER HAVING AN OPTICALLY-BASED AIMING SYSTEM

FIELD OF THE INVENTION

This invention relates generally to putters that are used in the game of golf; more specifically, it relates to an optical alignment system which may be used by a golfer to accurately orient the front face of a putter with respect to a remote cup, said cup being the target toward which a golf ball is to be propelled. The alignment system utilizes a selectively operable generator of radiant energy in the visible range, said generator being attachable to the shaft of most any putter (near the putter's grip) in essentially a universal manner.

BACKGROUND OF THE INVENTION

It is well known that there are some golfers who occasionally have trouble in correctly aligning their putters with respect to a cup that constitutes the target toward which a golf ball is to be propelled. And if the front face of a putter is not exactly perpendicular to a line that extends from the putter to the cup, there is a great probability that a struck ball will miss the cup—assuming that the green is essentially level, of course. In an effort to provide a visual aid for golfers, there has been disclosed a laser-based apparatus in U.S. Pat. No. 5,193,812 to Hendricksen entitled "Golf Club With Laser Alignment System." The Hendricksen system includes a laser that is attached at (or at least near) the head of a putter. As explained in the specification and recited in the claims, a Hendricksen laser is mounted in such a way that the laser will direct a beam of radiant energy horizontally from a mounting point above the putter's head—in the direction of a cup. It is said that this horizontal beam will be useful is verifying that the putter's head is correctly aligned with respect to a distant cup. However, those persons who know much about both golf and geometry may question whether it is automatic that the Hendricksen disclosure will lead to achievement of the announced goal. That is, the Hendrickson laser is shown in all cases as being located immediately above the putter's head; one reason for doing this, of course, is to ensure that the laser beam will be able to pass over a golf ball that is resting on the green in front of the putter's head. And because standard golf balls have a diameter of about 1.68 inches, we may presume that a horizontally directed beam of radiant energy (generated by the laser) may be two or more inches above the green when the putter is being held in an upright manner. However, it is well known that the standard cup toward which a ball is to be propelled will be below the green's surface—not above the surface where a horizontally directed beam of light could impinge on it.

So unless a beam of radiant energy is fully visible along its entire length (until it strikes some opaque object), the beam could pass directly over a distant cup and them would be no way for a human to know that any kind of alignment had ever been achieved, assuming—of course—that the day is clear and there is not a lot of dust floating immediately above the green. The lasers described by Hendrickson as being useful with his invention operate at such low power levels that a human who is standing alongside or above the beam cannot see it. Rather, what is visible to humans is the intersection of such a laser beam with some opaque matter (such as dust) or an opaque surface. Intersection of the laser beam with a surface is manifested as a small spot of light, usually red (with diode lasers), that appears on the surface. It follows, therefore, that a careful following of the Hendrickson instructions may not produce a result that is useful, unless the staff of a flag is left in a cup so that the laser beam can impinge on the staff.

While there may well be situations in which a golfer has a caddy who can hold a flag/staff above a cup for targeting purposes, it is likely that there will be many more situations in which a golfer will not have a caddy or golfing buddy who is willing to "do the flag thing." Hence, it is an object of this invention to provide an aiming apparatus that does not rely on a horizontally directed beam of radiant energy and does not rely on the presence of an opaque object above a cup in order to help a golfer orient his or her putter.

It is another object to provide an aiming device that can be attached to essentially all putters, so that a golfer need not abandon his or her favorite putter in order to take advantage of a "high tech" aid when the time comes to correctly align a putter with respect to a cup on a golf green.

One more object is to provide an aiming apparatus that can be suitably aligned with the shaft of a putter, then removed from that putter for storage or servicing, and subsequently returned to the putter and quickly restored to exactly the same orientation it once had—without any difficulty.

These and other objects will be apparent from a careful reading of the specification and the attached claims that follow, as well as reference to the several figures of the drawing that are provided herewith.

BRIEF DESCRIPTION OF THE FIGURES OF THE DRAWING

FIG. 6 is a perspective view of a putter which is located a short distance from the cup on a golf green, and showing (as an imaginary rectangle) the "plane" through which a beam of radiant energy will pass if and when the housing is caused to be manually rotated about its support shaft;

FIG. 8 is a top plan view of the head of a putter, showing a V-shaped marker that is impressed into the top of the head, and also showing a visible spot that is manifested when focused radiation from the generator is pointed straight down at the putter's head;

FIG. 9 is a perspective view of a portion of the shaft of a putter, said putter having been modified by the addition of a small rigid element that can permanently serve as a locating element for an alignment device in accordance with this invention;

FIG. 10 is a top plan view showing use of a T-square to aid in positioning of the alignment device with respect to a putter's shaft; and FIG. 11 is a circuit diagram for a timing circuit that can be used to automatically energize the light generator for a finite period of time, e.g., 15 seconds.

BRIEF DESCRIPTION OF THE INVENTION

Figure 2:
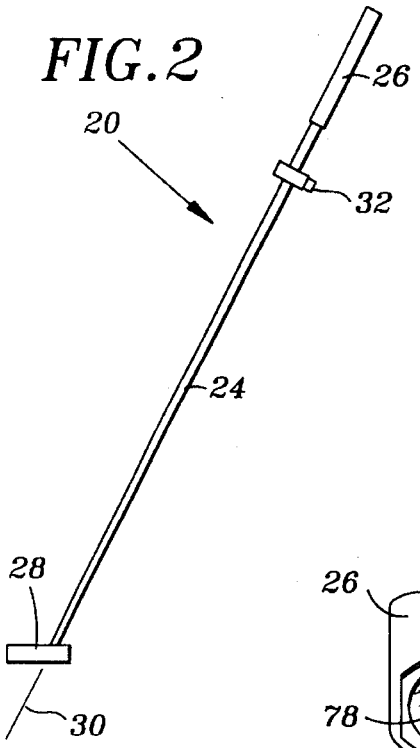
FIG. 2 is a front elevational view of a putter like the one shown in FIG. 1, showing the preferred location where an optical alignment apparatus may be mounted on the putter's shaft.

The invention may be briefly described as an aiming apparatus that is adapted for attachment to the shaft of a putter to help a golfer achieve a desired orientation for the putter's head during the act of putting. The desired orientation, of course, is one in which the putter's head is correctly oriented with respect to a cup on a golf green—said cup constituting the target toward which a golfer is about to direct a ball. The putter may be conventional in most respects, and will typically have an elongated shaft with proximal and distal ends; a handle (grip) is affixed to the shaft's proximal end and the head is affixed to the shaft's distal end.

The aiming apparatus includes a clamp for selective attachment to the putter's shaft near, or even on, the handle. Secured to the clamp is a battery-operated generator of radiant energy that is selectively operable by a golfer to direct a narrowly focused beam of radiant energy in a predictable direction. The generated radiant energy must be within the range of wavelengths that are visible to the human eye, or—at a minimum—there must be a visible spot at the point of impact of the radiant energy with an opaque object. A suitable generator for practicing this invention is a small, light-weight diode laser that is commercially available from Toshiba; it can produce a narrowly focused beam of visible radiation (i.e., light) at a wavelength of 670 nm.

The preferred generator (a Toshiba diode laser) has a molded plastic housing with an integral heat sink that can be safely handled. But while a Toshiba laser may be commercially available, it will be of negligible value to a golfer unless it is mounted in accordance with this invention—in a rotatable manner on the shaft of a putter. Only when so mounted can the laser be used to define a generally vertical plane that will pass through both the putter's head and a remote cup. The appropriate mounting step involves providing a means for supporting the laser housing with respect to the clamp in such a way that the direction of a beam of radiant energy may be selectively varied by the golfer. The preferred means includes an L-shaped member having two perpendicular legs, one of which has a distal end that will be referred to as a support post. The other one of the two L-shaped legs has a cylindrical outer surface, so that it may be selectively rotated with respect to a smooth bore in the static clamp. The variation in beam direction is accomplished while the golfer is holding the putter with a generally upright orientation; and the beam of radiant energy will extend from the generator to one or more spots on the golf green—each of which spots can be made to lie generally between the putter's head and the cup. The spot or spots will be visible to a golfer, and they will help the golfer judge whether the putter's head is correctly aligned with respect to the remote cup, before the ball is hit.

Of course, an optical generator (or laser) will only be functional whenever it can be powered, so a source of electrical power must be provided. In the preferred embodiment, this source is a portable battery that is selectively connectable to the laser to energize it and create a focused beam of radiant energy that is visible to the golfer as a small spot. This selective energization is ideally accomplished with a normally open switch that is connected in series with both the laser and the battery. The switch is typically placed near the putter's handle, where it may be selectively closed by a golfer in order to energize the laser for short periods of time. In one embodiment, turning the switch ON will energize a circuit to cause the optical generator to provide a beam of radiant energy for a finite period of time, e.g., about 5 to 15 seconds. By incorporating a timer circuit into the system, a golfer is not required to think about keeping a finger or thumb on a normally open switch.

After the laser housing has been tentatively mounted on the putter's shaft, it must be correctly aligned, and then the clamp must be fixed so that it is no longer subject to being shifted on the shaft. This may be conveniently done by using a large T-square, such as the type of tool that is commonly used by dry-wall contractors or paper hangers. The putter is placed so that its front face is flush with the rear edge of the T-square's short leg, with the long leg having an edge that extends forwardly from the center of the putter's head. The laser housing is rotated about its support post so that it points downwardly, and the switch is then momentarily closed to generate a small red spot (or dot). Selective rotation of the clamp with respect to the shaft, and rotation of the housing—as necessary—about a first one of the L-shaped member's two axes, is accomplished until the red dot is made to impinge on the top of the putter's head at the center thereof. Two threaded fasteners are then tightened to secure the L-shaped member against further rotation.

The housing is then rotated about its mounting post until the red dot appears well in front of the putter, near the distal end of the T-square. If necessary, a threaded fastener on the clamp may be loosened just enough to permit incremental rotation of the clamp (and its attached housing) about the putter's shaft—until the red dot is aligned with a remote edge of the T-square. When so aligned, the laser housing is secured where it will be correctly oriented for subsequent use by a golfer, and the support bracket is then rigidly secured to the shaft at this location by a threaded fastener. Thereafter, when the housing is rotated about its support post, the laser's dot can be made to sweep through a plane that is exactly perpendicular to the front face of the putter's head. The T-square will no longer be needed, because all of the necessary alignment steps have been completed.

Depending on the distance of the cup from the front face of the putter, selective rotation of the laser's housing about its support post can cause the laser's red dot to move from the top of the putter's head forward to the cup and then back again to the putter's head—without any movement of the putter. That is, the putter does not have to be moved in order to determine whether it is correctly aligned; only the laser's housing is rotated. If the red dot does not pass through the cup as the housing is rotated, the golfer will know that the front face of the putter is not perpendicular to an imaginary line from the putter's center to the cup. Changing the orientation of the putter can then be accomplished by the golfer in a traditional manner, by rotating the shaft a small amount about the shaft's longitudinal axis, until such time as the dot can be made to sweep through the cup. Anytime that a laser-generated dot can be made to pass through both the center of the putter's front face and the cup, then the putter's head will be oriented in such a way that it can propel a golf ball along a straight line to the cup. To the extent that a golfer perceives that the green is not flat and level, the golfer may choose to orient the putter so that it is canted away from a straight line to the cup. And to the extent that the golfer can accurately estimate whatever slope may be present in a green, the optical alignment device disclosed herein can be beneficial in helping a golfer decide how to orient the putter's head before striking a ball.

DETAILED DESCRIPTION OF A PREFERRED EMBODIMENT OF THE INVENTION

Figure 1:
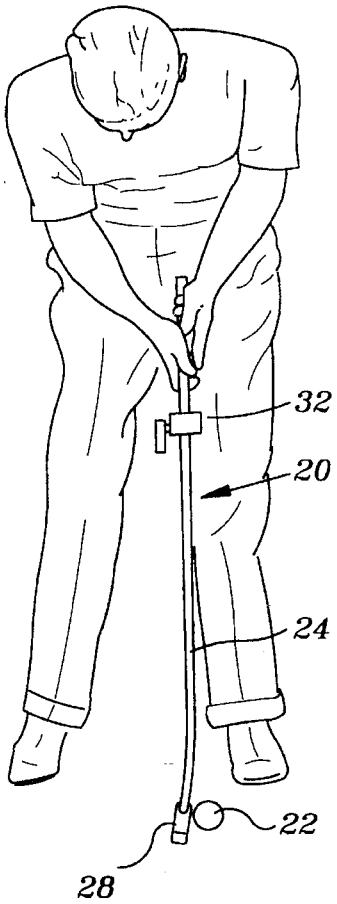
FIG. 1 is a perspective view of a golfer holding a putter with an optical alignment aid attached near the handle (i.e., the grip) of the putter.

Referring initially to FIG. 1, an exemplary male golfer is shown holding a putter 20 in a typical stance as he addresses a ball 22 on a golf green. The putter 20 has an elongated shaft 24 with a handle or grip 26 at its pendant end, and it has a head 28 (for striking the ball) at its distal end. The putter may be of essentially any design, because the alignment device of this invention is designed to be readily attached to any of a variety of putter shafts—in what may aptly be called a "universal" manner. While the alignment device may be attached to any of a variety of putter shafts, it is preferred that the attachment location be adjacent the handle; this keeps the weight of the alignment device very near a golfer's hands, and minimizes any effect on the "feel" of the putter as it is being swung.

Figure 3:
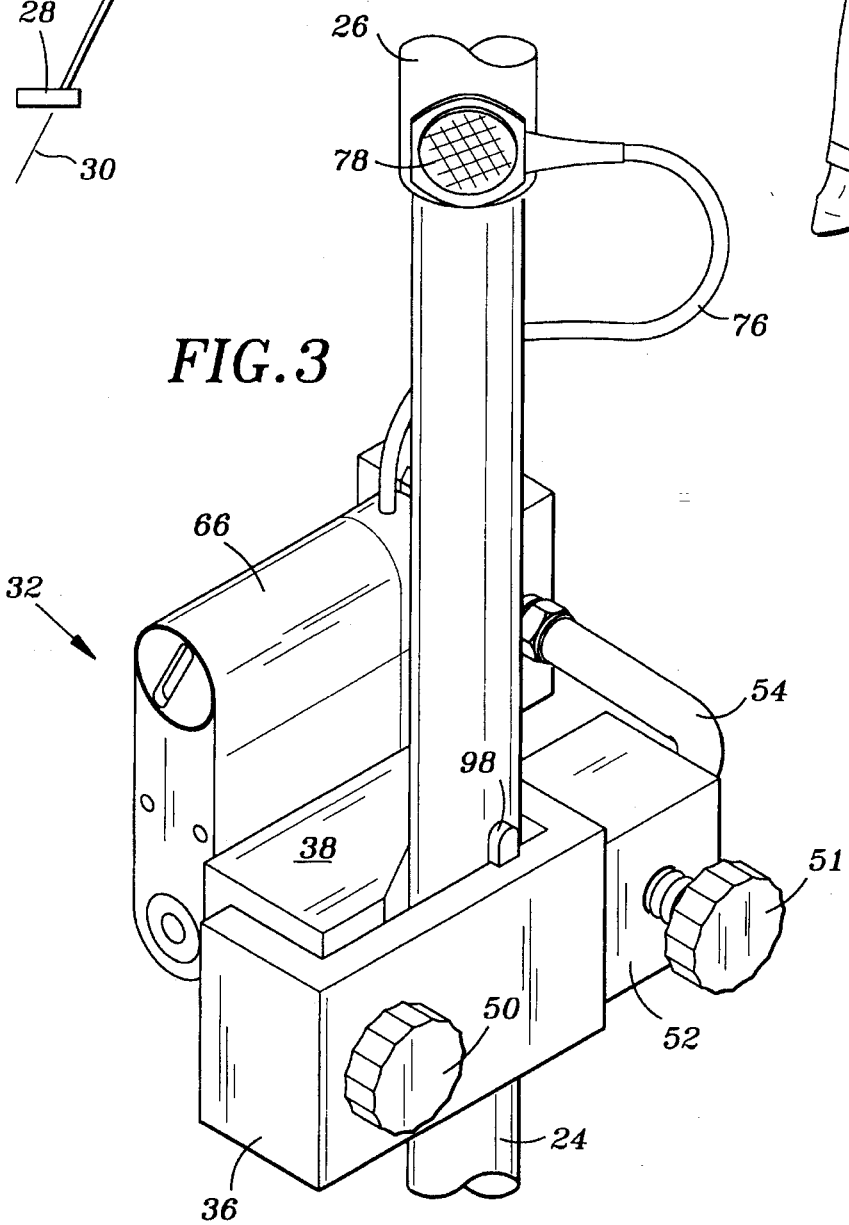
FIG. 3 is a perspective view of the alignment apparatus that is shown in FIG. 2, but at a scale that renders the various parts more identifiable.
Figure 4:
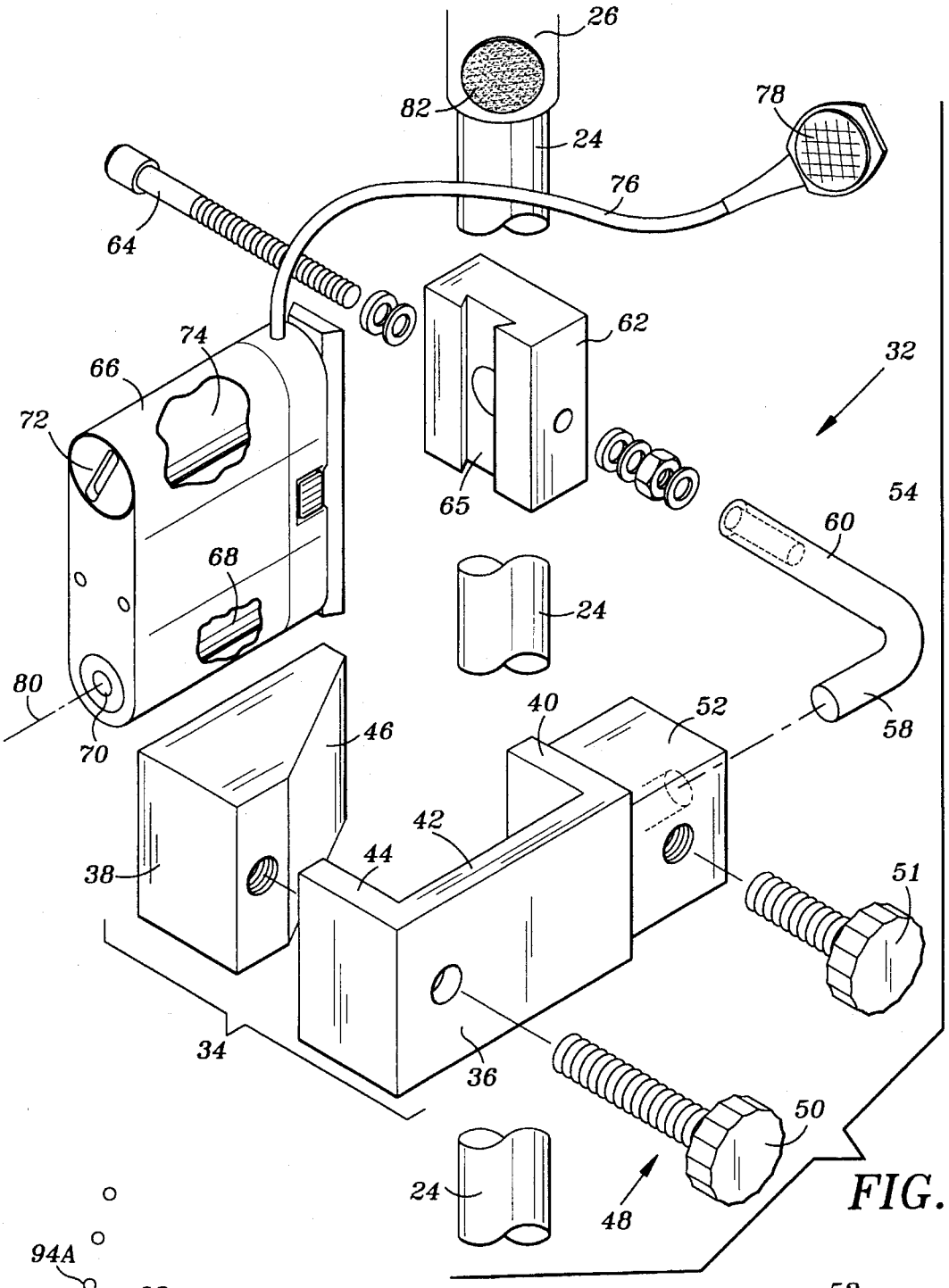
FIG. 4 is an exploded perspective view of the alignment apparatus shown in FIG. 3.

Turning next to FIG. 2, the putter 20 is shown with a generally upright orientation, with its longitudinal axis 30 being shown in a typical inclination of a few degrees away from vertical. Mounted on the shaft 24 and near the grip 26 is an optical alignment apparatus 32 in accordance with this invention. Referring next to FIGS. 3 and 4, the apparatus 32 includes a clamp 34 that preferably separates into two pieces 36, 38, one of which has a generally U-shaped portion, and the other being sized to snugly fit internally of the first. This relationship may best be seen in FIG. 4, wherein the first piece 36 has a U-shaped opening defined by walls 40, 42 and 44. The gap between generally parallel walls 40, 44 may advantageously be about two inches, and it should be a few thousandths of an inch less than the width of mating piece 38. A face 46 on piece 38 is inclined upwardly to provide clearance for the shaft of a putter, as the pieces 36, 38 are brought together by the act of tightening a threaded member 48 into a bore in piece 38. As illustrated, the threaded member 48 has a relatively large head 50, so that it may be grabbed and manually tightened and untightened without the need for any tools.

Figure 5:
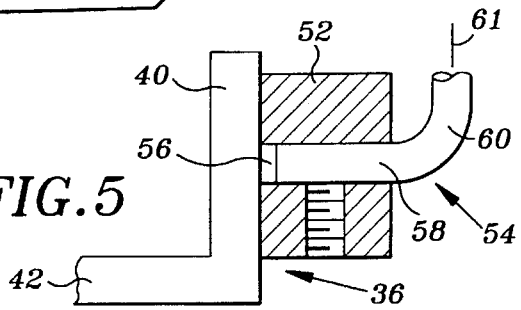
FIG. 5 is a fragmentary top plan view, partially cross-sectioned, of an L-shaped member that is designed to mate at one end with the cylindrical bore of the clamp, and designed to rotatably support at its other end the housing of a generator of radiant energy (e.g., a laser)

Referring additionally to FIG. 5, clamp piece 36 also has a structural portion 52 that lies alongside the clamping portion and generally outside the region where the clamping action on a shaft 24 takes place. This structural portion 52 provides a base with respect to which an L-shaped member 54 may be selectively rotated, by virtue of providing a generally cylindrical bore 56 that extends transversely with respect to the longitudinal axis 30. The member 54 has two perpendicular legs 58, 60, and leg 58 has an external size that causes it to fit snugly into bore 56. For convenience in manufacturing, the L-shaped member 54 is made of a unitary piece of metal, e.g., steel, so both legs 58, 60 will have the same external configuration. A suitable material for the clamping pieces 36, 38 is 6061 T6 aluminum; making the two largest pieces of the apparatus 32 out of aluminum helps keep the total weight of the apparatus relatively low. In fact, a preferred embodiment of the apparatus 32 (including a laser and battery) weighs only a few ounces. And by virtue of the fact that the apparatus 32 is designed to be mounted near the putter's grip 26, the dynamic impact of the apparatus on a golfer's swinging action should be almost imperceptible. Those familiar with kinematics will recognize that a very different condition arise if the apparatus 32 were to be mounted at the distal end of the shaft 24 rather than at the pendant end thereof.

Connected to the leg 60 is a mounting bracket 62 that is rigidly secured with a threaded member 64, e.g., a bolt, whose external threads are complementary to the internal threads in the end of leg 60. The internal threads are coaxial with the longitudinal axis of leg 60, said axis being represented in FIG. 5 by line 61. This mounting bracket 62 has a groove 65 into which may be slipped a generally dovetail element that extends outwardly from a housing 66. The housing 66 holds a battery-operated generator of radiant energy 68, e.g., a diode laser, whose output is manifested as a beam of light that is focused through lens 70. A suitable generator 68 for practicing this invention is a small, lightweight diode laser that can produce a narrowly focused beam of visible radiation (i.e., light) at a wavelength of 670 nm. Such a generator is commercially available from Toshiba Corporation under the commercial designation TOLD9200.

Also visible on what may be aptly called the front face of the housing 66 is a threaded end cap 72, said end cap being selectively removable to expose a cavity within the housing; the cavity is sized for receiving a battery 74 that is electrically connected for energizing the generator 68. By removing the end cap, the battery can be selectively removed and replaced without removing the housing from the shaft. Extending outwardly from the housing 66 is a flexible cable 76 that is terminated at a pressure-sensitive switch 78. The preferred switch 78 is a normally-off, momentarily-on switch that can be readily pressed by a golfer's index finger to energize the laser 68 and cause a beam of light—indicated in the drawing by the line 80—to be projected in front of the housing 66. The switch 78 is held in a selected position on a bottom portion of the grip 26 by a set of selectively releasable fasteners, e.g., hook and loop fasteners of the kind that are widely sold under the trademark VELCRO. A circular patch 82 constituting one-half of a VELCRO fastener is shown attached to the grip 26, where it can be selectively engaged by a matching patch on the bottom of the switch 78.

Turning next to FIG. 6, the housing 66 is shown suspended in air (for simplicity), although it will be remembered that the housing will actually be affixed near the putter's grip. For the purpose of explaining operation of the apparatus, a generally vertical plane 90 has been illustrated as passing through three points: the housing 66, the center of a putter's head 28; and a target, e.g., the cup or hole 92 into which a golfer wishes to propel a golf ball. Another way of considering the plane 90 is to recognize that it may be described as being defined by the construction lines 80A, 80B, 80C and 80D. These four lines are provided to represent four sequential light rays that emanate from the generator 68 at four different times as the generator is rotated about axis 61. The first ray 80A extends downwardly from the generator 68 while the putter is being held with a generally upright orientation, and ray 80A passes through the center of the putter's head. The orientation of this first ray 80A is not by accident; it is deliberately arranged to be so by some preliminary installation steps that are typically taken by a golfer before he/she ever gets on the golf course. These installation steps will be described in a later portion of this specification.

Line 80B shows the position of an exemplary beam of light after the housing 66 has been manually rotated about arm 60 by a small angle. Such rotation is made possible by adjusting the tension in bolt 64 so that it is sufficient to hold the housing 66 in a stable manner with respect to clamp 34—while still permitting the housing to be selectively rotated. Line 80C shows the position of an exemplary light ray after the housing 66 has been rotated still further, and line 80D shows that a light ray can be made to pass through the target (i.e., the cup) when the housing is rotated by a sufficient amount and the putter is correctly oriented. If the putter were to be manually turned by a golfer in such a way that the head 28 is rotated slightly clockwise, then ray 80D would never intersect the cup; instead, it would pass to the right thereof. Similarly, if the putter is oriented incorrectly by being canted counterclockwise, then light ray 80D would miss the cup 92 to the left. It follows, therefore, that observing the relative position of light ray 80D with respect to the cup can convey information to a golfer as to whether the putter's head is being correctly held and oriented in the golfer's hands.

Figure 7:
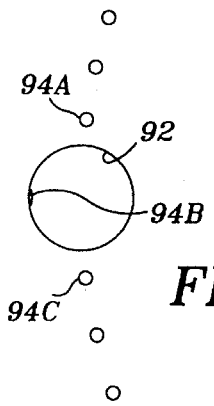
FIG. 7 is a top plan view of the region surrounding a cup on a golf green, and indicating places where a light beam might intersect the golf green.

Of course, the light rays 80A, 80B, 80C and 80D may not be visible to a golfer on a brightly lit green. But the point of impact of these light rays with an opaque surface will be manifested as a series of dots 94A through 94C on the green's surface as the generator projects its light rays downwardly from the housing 66. These relatively small dots on the green are shown in FIG. 7, although it will be understood that all of the dots would not be visible at the same time. Only a single dot would be visible at any given time, but the sequence of their appearance is suggested in this figure as the putter is rotated by a golfer about a generally vertical axis. If the putter is not being held so that the head 28 is "square" with the cup 92, then one of the dots 94A or 94C will likely be manifested for the golfer. Rotating the putter in the correct direction (right or left, as the case may be) will eventually cause the light beam to produce a spot indicated as spot 94B, and the front face of the putter's head will at that moment be exactly perpendicular to a construction line drawn between the hole 92 and the head 28.

Now that the use of the optically-based alignment system has been explained, it will be appropriate to devote some attention to the installation of an apparatus 32 on a putter 20. The act of correctly installing an apparatus 32 must be explained, because an advantage of the system taught herein is that an apparatus can be installed on essentially any putter—on what may be aptly called a do-it-yourself basis. Hence, a person does not have to go to a pro-shop to have the installation work accomplished; neither does he or she have to discard a favorite old putter that has either significant sentimental or financial value to the owner. Hence, a person might attach a new apparatus 32 to an old putter that was once a Christmas present from some loved one, or to a new putter whose cost might make a down payment on some used cars. Also, the apparatus 32, once installed, does not have to remain on a putter 20; after the apparatus has served its purpose in sharpening a player's skills in putting, it may be removed, either permanently or selectively.

After the laser housing 66 has been tentatively mounted on the putter's shaft, it must be correctly aligned, and then the clamp 34 must be fixed so that it is no longer subject to being shifted on the shaft. This may be accomplished by taking advantage of a linear pattern on a floor, or by using a large T-square. The "floor" method of alignment will be described first. Assuming that the floor is composed of a plurality of side-by-side hardwood boards that are parallel to the walls of a rectangular room, the putter's head 28 is positioned so that it rests on top of the floor, with its center aligned with the edge of a particular board. If the face of the putter is perpendicular to the board's edge, then that edge can be used to identify a remote spot (at the wall) that is in the plane that extends perpendicularly from the putter's face. To achieve alignment, therefore, the laser is actuated and the clamp is loosened just enough to permit the apparatus 32 to be positioned in such a way that the laser's beam will strike that remote spot where the vertical wall intersects the board's horizontal edge. The clamp 34 is then tightened at this desired location with respect to the putter's shaft.

If a room with a hardwood floor is not conveniently available to a golfer, a kitchen floor with square tiles can be used as a substitute, provided that the person who installed the floor did so in a conventional manner and a series of tiles define a straight line that can be used for alignment purposes.

While the above alignment process is not really tedious or very time consuming, there may be those persons who might like to accomplish the process once—and then never have to repeat it, even if them is a desire to someday remove the clamp and the rest of the apparatus 32 from the putter. To this end, a mark may be placed on the housing 66 and another on the shaft 24, so that repeated alignment of the housing and shaft may be accomplished by placing the two marks together (after they have been separated). Alternatively, a small, rigid locator block 98, shown in FIG. 9, may be permanently attached to the shaft of a putter with epoxy or the like, after alignment has once been achieved. The block 98 is sized to fit snugly within a matching groove in the clamp 34, on the inside surface of one of the walls 40 or 44. The clamp 34 may then be repeatedly installed and removed from the putter's shaft at will, by simply engaging the protruding block with the groove, and then tightening the bolt 50 to achieve a squeezing action on the shaft.

If neither a hardwood floor nor a rectangular tiled floor is available, a golfer can still install and align the apparatus 32 with relative ease by using a large T-square, e.g., the type of tool that is commonly used by dry-wall contractors or paper hangers. (Such a tool is shown in FIG. 10.) The putter 20 is placed so that its front face is flush with the rear edge of the T-square's short leg. The putter's face is positioned so that an edge of the T-square's long leg will extend forwardly from the center of the putter's head. The laser housing 66 is rotated about its support post 60 so that it points downwardly, and the laser's switch is then momentarily closed to generate a small red spot (or dot). Selective rotation of the clamp 34 with respect to the shaft, and rotation of the housing 66—as necessary about—a first one of the L-shaped member's two axes, is accomplished until the red dot is made to impinge on the top of the putter's head at the center thereof. The two threaded fasteners 50, 51 are then tightened, to secure the clamp 34 against rotation with respect to the shaft 24, and to secure the L-shaped member 54 against rotation with respect to the clamp.

The housing 66 is then freely rotated about its mounting post 60 until the red dot appears well in front of the putter, near the distal end of the T-square. If necessary, the first threaded fastener 50 may be loosened just enough to permit incremental rotation of the clamp (and its attached housing) about the putter's shaft—until the red dot is aligned with a remote edge of the T-square. When so aligned, the laser housing 66 will be correctly oriented for subsequent use by a golfer, and the support bracket 54 rigidly at this location by the second threaded fastener 51. Thereafter, when the housing 66 is rotated about its support post 60, the laser's dot can be made to sweep through a plane that is exactly perpendicular to the front face of the putter's head. The T-square will no longer be needed, because the necessary alignment steps have been completed.

Depending on the distance of the cup from the front face of the putter 20, selective rotation of the laser's housing 66 about its support post 60 can cause the laser's red dot to move from the top of the putter's head forward to the cup and then back again to the putter's head—without any movement of the putter. If the red dot does not pass through the cup as the housing is rotated, the golfer will know that the front face of the putter is not perpendicular to an imaginary line from the putter's center to the cup. Changing the orientation of the putter can then be accomplished by the golfer in a traditional manner, by manually rotating the shaft a small amount about the shaft's longitudinal axis, until such time as the dot can be made to sweep through the cup. Anytime that a laser-generated dot can be made to pass through both the center of the putter's front face and the cup, then the putter's head will be oriented in such a way that it can propel a golf ball along a straight line to the cup. To the extent that a golfer perceives that the green is not flat and/or level, the golfer may choose to orient the putter so that it is canted away from a straight line to the cup. And to the extent that the golfer can accurately estimate whatever slope may be present in a green, the optical alignment device disclosed herein can be beneficial in helping a golfer decide how to orient the putter's head before striking a ball.

Placing the switch 78 near the putter's grip 26 will, of course, make it easy for a golfer to actuate the laser to obtain the desired beam of light whenever it is needed. On the other hand, there may be some persons who wish to focus their attention so intensely on the ball and their planned stroke that they do not want to be distracted by the slightest thing—including having to depress the switch. For these persons, an optional feature is available, namely, a timer circuit 100 that is inserted into the electrical circuit for the laser, so that a beam of light can be generated for a finite period of time and then automatically turned off. Such a circuit 100 is shown in FIG. 11, which constitutes a MOSFET power transistor that is switched on/off by a timer circuit, using a MAX620 device (from MAXIM Semiconductors). A very low power CMOS timer 102 from Texas Instruments is used in the circuit; it is identified in the figure as a TI TLC 555C timer. A manual touch of the plate 104 turns the timer 102 on for a period of time that is defined by the formula $T=1.1\ C_tR_t$. Assuming that a period of 15 seconds is desirable for laser actuation, and using a 1.0 microFarad capacitor, a resistor rated at 14 Megohms will provide the desired energization time for the laser. Changing the values of $C_t$ and $R_t$ will, of course, change the duration of the laser's operation. Those skilled in the art will also appreciate that it would be possible to alter the driving circuit to produce an intermittent (i.e., pulsed) laser beam instead of a steady beam—to conserve battery power.

While the apparatus 32 has been described herein as having particular utility in helping a golfer on a golf green, the apparatus may also be effectively used when a golfer is practicing his or her putting anywhere—including the carpeted floor of a den, recreation room or living room. Hence, it would be best to simply think of the cup on a golf green as being exemplary of any number of targets toward which a golf ball is to be propelled. Also, if the target is a cup on a brightly illuminated green, it may be advantageous for the golfer to wear tinted glasses, to filter out that natural radiation (from the sun) that would make it harder to see the red dot generated by the laser.

While the preferred apparatus for practicing the invention has been disclosed herein in great detail, those skilled in the art will no doubt recognize that variations of the concept could also be made. Hence, the scope of the invention should be deemed to be measured only by the claims that are attached hereto.

What is claimed is:

1. An aiming apparatus attached to the shaft of a putter to help a golfer achieve a desired orientation for the putter's head, said desired orientation being one in which the head is desirably oriented with respect to a target toward which a golfer is about to direct a ball, said putter having an elongated shaft with proximal and distal ends, and there being a grip affixed to the shaft's proximal end and a head affixed to the shaft's distal end, comprising:

a) a clamp selectively attached to the putter's shaft near the grip;

b) a battery-operated generator of radiant energy that is selectively operable by a golfer to direct a narrowly focused beam of radiant energy in a predictable direction, said radiant energy being within the range of wavelengths that are visible to the human eye, and the generator having a housing;

c) means for supporting the generator housing with respect to the clamp in such a way that the direction of the beam of radiant energy may be selectively varied by the golfer while the golfer is holding the putter with a generally upright orientation, and the beam of radiant energy extending from the generator to a spot that lies generally between the putter's head and the target, and said spot being visible to said golfer; and d) a battery which is selectively connectable to the generator, such that the generator may be selectively energized by said golfer in order to generate a focused beam of radiant energy to create the visible spot.

2. The combination of claim 1 and further including a normally open switch that is connected in series with both the generator and the battery, said switch being selectively closable by a golfer in order to energize the generator and thereby create the visible spot.

3. The combination of claim 1 wherein the means for supporting the generator housing with respect to the clamp includes an L-shaped member having two perpendicular legs, and wherein at least one of the two legs has a cylindrical outer surface that fosters selective rotation with respect to a cylindrical bore in the clamp.

4. The combination of claim 1 wherein the radiant energy generator is a diode laser.

5. The combination of claim 1 wherein the putter's shaft has a longitudinal axis, and wherein the generator housing is supported in such a way that the beam of radiant energy is movable in a plane that passes through both the generator and a spot on the putter's head, and wherein said plane is adjustable with respect to the longitudinal axis of the shaft, whereby the golfer may adjust the point of impact of the beam of radiant energy with the putter's head.

6. The combination of claim 1 wherein the shaft is generally cylindrical in the region near its handle, and the generally cylindrical region has a circumference, and the clamp is circumferentially adjustable with respect to shaft, such that the orientation of the attached generator can be adjusted with respect to the circumference of the shaft by incrementally rotating the clamp around the shaft.

7. The aiming aparatus as claimed in claim 6 wherein the clamp is rotatable about the shaft by very small increments so as to create a substantial number of potential spatial relationships between the clamp and the shaft.

8. The combination of claim 1 wherein there is a preferred spatial relationship between the clamp and the putter's shaft, and further including means for providing a visual indication of when the preferred spatial relationship has been established between the clamp and the putter's shaft, such that the clamp may be temporarily removed from the shaft and thereafter restored to essentially the same spatial relationship it had before it was removed from the shaft, and said restoration involving use of the means for providing a visual indication of the preferred spatial relationship.

9. The combination of claim 1 wherein there is a preferred spatial relationship between the clamp and the putter's shaft, and further including a mechanical means for repeatedly establishing said preferred spatial relationship, whereby the clamp may be removed from the shaft and then at any time mechanically restored to essentially the same spatial relationship that it had before it was removed from the shaft.

10. The combination of claim 1 wherein the shaft has a longitudinal axis, and the clamp is longitudinally adjustable along the length of the shaft, whereby the orientation of the generator with respect to the putter's head can be changed by virtue of adjusting the longitudinal position of the clamp along the shaft.

11. The aiming apparatus as claimed in claim 10 wherein the orientation of the generator with respect to the putter's head is selectively positionable by virtue of manually adjusting the tension in a threaded member that is carried on the clamp.

12. The combination of claim 1 wherein the generator is selectively operable by use of a pressure-sensitive ON/OFF switch that is in series with the battery and is mounted on the putter's handle near the location where the grip is affixed to the putter's shaft.

13. The aiming apparatus as claimed in claim 12 wherein the ON/OFF switch is normally biased to an OFF position, and is only momentarily ON whenever the switch is being pressed by a golfer.

14. The combination of claim 1 wherein the clamp is attached to the shaft with a threaded member that is secured by manually rotating a knob without the aid of any tools.

15. The combination of claim 1 wherein the clamp has a locating mark on an external surface that is visible to a golfer, and the putter's shaft is provided with a similar mark that is aligned with the clamp's locating mark, whereby the clamp may be selectively removed from the shaft and then returned to the same location on the shaft by restoring the original alignment between the two marks.

16. The combination of claim 1 wherein the battery for the battery-operated generator is replaceable without removing the generator housing from the shaft.

17. The combination of claim 1 wherein the focused beam of radiant energy is projected from the generator housing in a direction that is adjustable by manually rotating the generator's housing in opposition to the friction that has been established by a mounting screw, and wherein the friction that has been established by the mounting screw is selectively adjustable by the golfer.

18. In the game of golf, the method of improving the alignment of a putter's head with respect to a target toward which a golfer is about to direct a golf ball, said head having a front face which is used to strike the golf ball, and including the use of a battery-powered generator of radiant energy that is sufficiently light-weight as to be attachable to the shaft of the putter without significantly interfering with the natural feel of the putter, and said putter having a grip at the top of the shaft, comprising the steps of:

a. mounting the housing of a small, light-weight, battery-operated generator of radiant energy on the shaft of a putter adjacent the putter's grip, said mounting step being done in such as way as to permit selective adjustment of the relative position of the generator housing with respect to the putter's shaft;

b. adjusting the position of the generator housing with respect to the putter's shaft until the housing reaches a position at which a generated beam of radiant energy will be perpendicular to the front face of the putter;

c. selectively activating the generator in order to cause a beam of radiant energy to be directed downward from the generator's housing and to impinge upon the region near the target; and d. manually rotating the generator's housing to cause the beam of radiant energy to sweep in a generally upright plane that extends perpendicularly from the front face of the putter, and the beam of radiant energy being manifested as a spot that moves as the housing is rotated, whereby the golfer may observe the location where the beam of radiant energy impinges and thereby determine whether the putter's front face is perpendicular to a line that extends from the putter's head to the target.

19. The method of improving the alignment of a putter's head as claimed in claim 18 wherein the generator is actuated for a finite period of time and then is automatically turned off, whereby the beam of radiant energy will be visible for a finite period of time that is established by the ON cycle of the generator.

20. The method of improving the alignment of a putter's head as claimed in claim 18 wherein the step of adjusting the position of the generator's housing with respect to the putter's shaft is accomplished by initially placing an alignment tool on a generally horizontal surface in front of the putter's head, said alignment tool having a pair of perpendicular arms arranged in the manner of a T-square, and including the step of placing a first one of the tool's two arms parallel to the putter's front face, and adjusting the position of the generator's housing until a generated beam of radiant energy impinges at a desired location on a remote portion of the tool's second arm, and then fixing the generator's housing to the putter's shaft, whereby the generator will continue to provide a beam of radiant energy that is perpendicular to the front face of the putter even after the tool has been removed.

21. In the game of golf, the method of orienting the front face of a putter so that it is exactly perpendicular to an imaginary line that extends from a point on the putter's front face to a target toward which a golfer wishes to propel a golf-ball, and said putter having a head with a front face, a grip, and a shaft extending between the grip and the head, comprising the steps of:

a. attaching to the putter's shaft adjacent the putter's grip a source of radiant energy, said source being attached in such a way that a beam of energy from said source can be focused to a relative small spot coinciding with the front face of the putter, and the attaching step being effective to cause a beam of energy generated by the source to lie in a plane that is perpendicular to the front face of the putter;

b. holding the putter static and simultaneously rotating the source of radiant energy with respect to the putter's shaft, said rotation being accomplished about an axis that is fixed with respect to the shaft, and said rotation being accomplished to define an imaginary sighting plane that passes through the relatively small spot and projects in front of the putter's front face; and c. subsequently adjusting the orientation of the putter's face with respect to the target by incrementally rotating said face about a generally vertical axis until the imaginary sighting plane passes simultaneously through the relatively small spot and the target, whereby the putter's face will inherently be perpendicular to a line that extends between the putter's face and the target.

* * * * *